US010414621B2

(12) United States Patent
Lupi et al.

(10) Patent No.: US 10,414,621 B2
(45) Date of Patent: Sep. 17, 2019

(54) OPERATING UNIT FOR INTERLEAVING MACHINES

(71) Applicant: UNITED CONVERTING S.R.L., Piano di Coreglia, Coreglia Antelminelli (IT)

(72) Inventors: Giuseppe Lupi, Gallicano (IT); Gianluca Giometti, Capannori (IT); Angelo Torri, Gallicano (IT)

(73) Assignee: UNITED CONVERTING S.R.L., Coreglia Antelminelli Lucca (IT)

( * ) Notice: Subject to any disclaimer, the term of this patent is extended or adjusted under 35 U.S.C. 154(b) by 0 days.

(21) Appl. No.: 16/073,040

(22) PCT Filed: Jan. 19, 2017

(86) PCT No.: PCT/IT2017/000008
§ 371 (c)(1),
(2) Date: Jul. 26, 2018

(87) PCT Pub. No.: WO2017/134693
PCT Pub. Date: Aug. 10, 2017

(65) Prior Publication Data

US 2019/0023519 A1 Jan. 24, 2019

(30) Foreign Application Priority Data

Feb. 2, 2016 (IT) ..... 102016000010399

(51) Int. Cl.
*B65H 45/10* (2006.01)
*B65H 45/24* (2006.01)
(Continued)

(52) U.S. Cl.
CPC ..... *B65H 45/10* (2013.01); *B41L 43/06* (2013.01); *B65H 20/005* (2013.01); *B65H 20/12* (2013.01);
(Continued)

(58) Field of Classification Search
CPC ..... B41L 43/06; B65H 45/10; B65H 45/101; B65H 45/20; B65H 45/163; B65H 45/24;
(Continued)

(56) References Cited

U.S. PATENT DOCUMENTS 5,067,698 A * 11/1991 Stemmler ..... B65H 45/24 270/21.1
5,088,707 A * 2/1992 Stemmler ..... B65H 45/24 270/32

(Continued)

FOREIGN PATENT DOCUMENTS

EP 1630118 A1 3/2006
IT BO20080167 A1 9/2009

*Primary Examiner* — Leslie A Nicholson, III
(74) *Attorney, Agent, or Firm* — McGlew and Tuttle, P.C.

(57) ABSTRACT

An interleaving unit, comprising a pair of rolls (1, 2) set alongside one another and counter-rotating and provided with respective first and second folding tools (3, 4; 5, 6) set at a distance from one another along the circumferential development of the respective peripheral surfaces so as to operate in a common point of tangency (Z) on a succession of sheets (7*a*, 7*b*) fed between the two rolls, said tools (3, 4; 5, 6) being set on respective mobile cylinder sectors (8, 9, 10, 11) to enable positioning thereof at an adjustable distance apart along the circumferential development of a corresponding roll (1, 2), said interleaving unit comprising means (M1, M2, U) for independently adjusting the speed of rotation of one or more of said sectors according to their angular position in order to reduce or increase the peripheral speed of said sectors with respect to a speed of feed (Vm) of said sheets.

10 Claims, 6 Drawing Sheets

Figure 2:
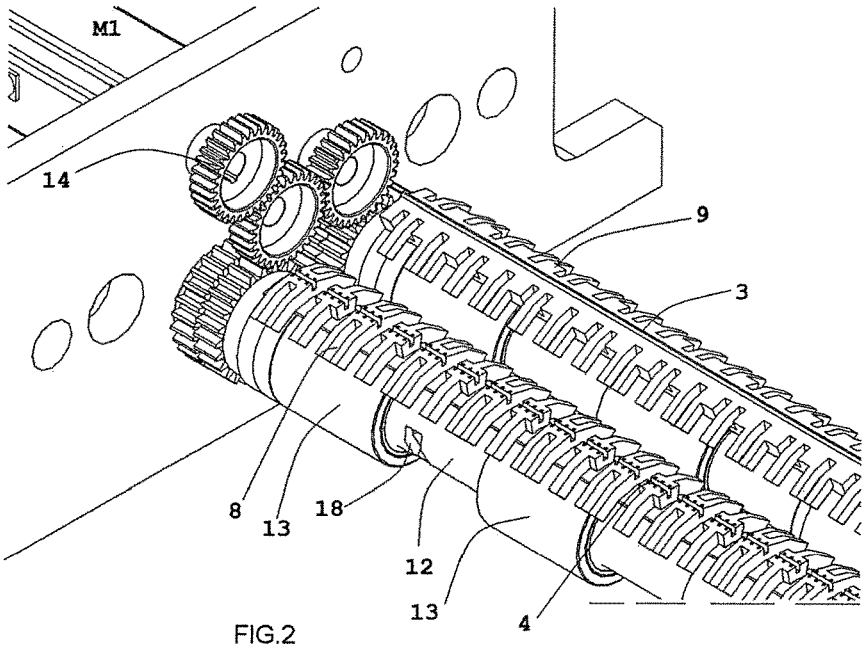

(51) Int. Cl.

| | |
|---|---|
| ***B65H 45/28*** | (2006.01) |
| ***B41L 43/06*** | (2006.01) |
| ***B65H 20/00*** | (2006.01) |
| ***B65H 20/12*** | (2006.01) |
| ***B65H 45/101*** | (2006.01) |
| ***B65H 45/16*** | (2006.01) |
| ***B65H 45/20*** | (2006.01) |

(52) U.S. Cl.
CPC ..... *B65H 45/101* (2013.01); *B65H 45/163* (2013.01); *B65H 45/20* (2013.01); *B65H 45/24* (2013.01); *B65H 45/28* (2013.01); *B65H 2404/1141* (2013.01); *B65H 2404/12* (2013.01); *B65H 2511/11* (2013.01); *B65H 2511/21* (2013.01); *B65H 2701/1924* (2013.01)

(58) Field of Classification Search
CPC ..... B65H 45/28; B65H 20/005; B65H 20/12; B65H 2404/1141; B65H 2404/12; B65H 2511/11; B65H 2511/21; B65H 2701/1924
USPC ..... 270/39.01, 39.05, 39.07; 271/270
See application file for complete search history.

(56) References Cited

U.S. PATENT DOCUMENTS

| | | | | |
|---|---|---|---|---|
| 7,717,839 | B2 * | 5/2010 | Butterworth | B65H 45/24 270/39.05 |
| 7,997,570 | B2 * | 8/2011 | De Matteis | B65H 31/32 270/39.02 |
| 8,172,212 | B2 * | 5/2012 | Lien | B65H 45/24 270/39.01 |
| 8,490,958 | B2 * | 7/2013 | Walsh | B65H 31/3045 270/32 |
| 8,544,833 | B2 * | 10/2013 | Walsh | B65H 31/06 270/32 |
| 9,004,480 | B2 * | 4/2015 | Hsu | B65H 45/24 270/39.01 |

* cited by examiner

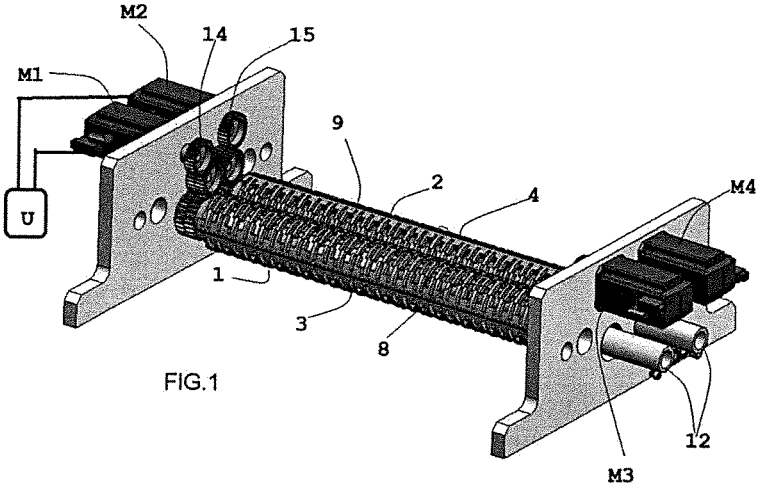
FIG.1
FIG.1A
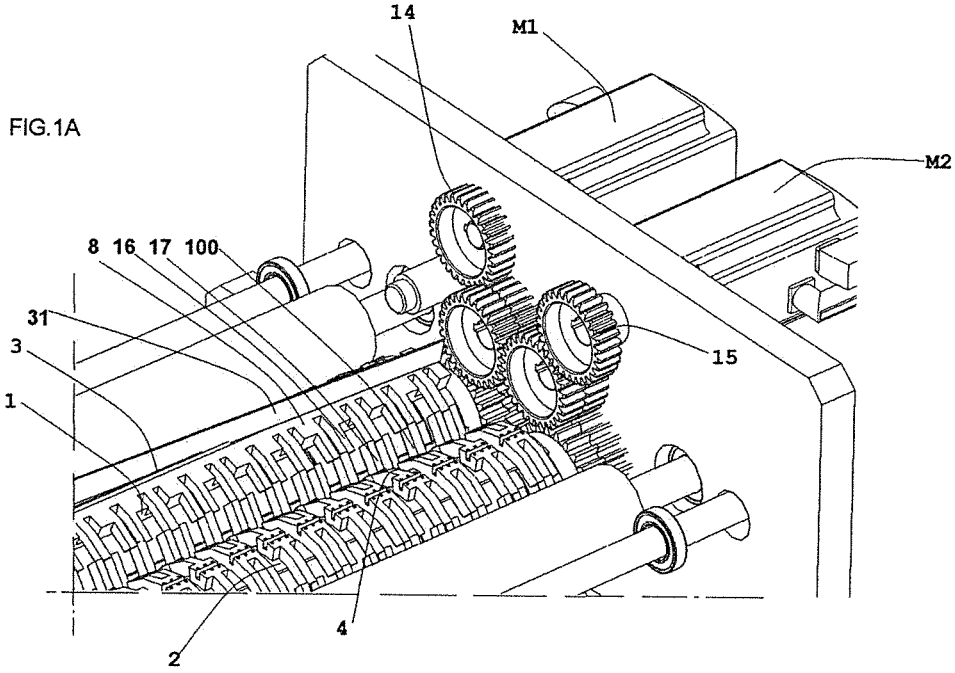

OPERATING UNIT FOR INTERLEAVING MACHINES

TECHNICAL SECTOR OF THE INVENTION

The invention relates to an operating unit for cutting and/or folding sheets of paper that are interleaved, i.e., folded and stacked so as to obtain a partial overlapping of the adjacent flaps of the sheets. This type of arrangement is used, for example, for creating packs of serviettes stacked on top of one another so that when a serviette, set in a pull-out position, is pulled out, a flap of the underlying serviette will be automatically raised, thus facilitating subsequent extraction thereof.

Possible uses of this arrangement are for toilet paper, face tissues, etc.

PRIOR ART

The machines used for cutting, folding, and arranging in numbered packs sheets of this type are commonly referred to as "interleaving machines" and are continuously fed off a reel of web that is then divided into packs of sheets cut to size. In their operation, interleaving machines envisage a pair of counter-rotating rolls set alongside one another, between which the sheets to be cut/folded are passed.

According to the function that they are to perform, cutting blades or reliefs may be provided on the surfaces of one of the rolls, and respective grooves may be provided on the opposite roll that rotate in phase with the blades/reliefs so as to obtain cutting or folding of the sheet being processed.

Once folding has been carried out, the sheets are taken up by an underlying device generally referred to as "stacker", which forms numbered packs of sheets and that operates in phase with rotation of the rolls.

The known systems present, however, serious drawbacks because the two counter-rotating rolls must necessarily have a certain diameter, i.e., a certain circumferential development, for each format of length of the sheets, which will correspond to the distance between the blades/reliefs measured on the circumference of the roll and to the distance between the grooves on the opposite roll.

Consequently, when it is necessary to produce sheets of different length it is generally necessary to use a different machine, with evident increase in costs and difficulty in carrying out in short times a change of format of the sheets produced.

From EP 1630118 an interleaving machine is known devised for producing sheets of different length by replacement of an interchangeable interleaving unit.

This machine presents, however, a relative complexity (as many interleaving units are necessary for each length of the sheets) and relatively long times for change of format.

From the patent application No. BO2008A000167 filed in the name of the present applicants a unit for interleaving machines is known in which two counter-rotating rolls are provided, mounted on each of which are tools for folding the sheets, which can be set at an adjustable circumferential distance so as to be able to vary the length of the stretch of sheet that remains between two folds, and determines the format of the sheets.

The machine described in BO2008A000167 presents, however, some limits due to the complexity of the mechanisms that are to implement the change of format of the sheets and to the relative rigidity of operation.

Furthermore, the cam mechanism described therein requires an intervention of replacement of all the cams that govern displacement of the mobile sectors as the desired format varies, in particular for very different formats, which depart from the narrow range of adjustment of the eyelets.

This intervention, in addition to being in itself relatively complex, implies a high machining precision and does not in any case allow an effective independence and an immediate modification of the parameters of adjustment of the positions of the tools throughout the processing cycle.

There is hence felt the need for an interleaving unit that will have an efficient and reliable structure and will enable any possible need for change of format to be achieved and controlled in a flexible way.

PURPOSE OF THE INVENTION

The purpose of the present invention is to propose an interleaving unit that enables the drawbacks of the already known solutions to be overcome and in particular enables variation in a simple and rapid way of the length of the sheets produced.

According to the invention, the above purpose is achieved by an interleaving unit according to the main claim.

Further technical purposes and advantages are obtained with a unit according to the dependent claims.

SUMMARY OF THE INVENTION

The above purposes have been achieved by providing an interleaving unit according to at least one of the annexed claims.

A first advantage lies in the fact that the machine according to the invention enables change of format of the sheets produced in a simple and reliable way by controlling the speed of rotation of the tool-carrying sectors and hence their distance apart during winding and processing of the sheets.

A second advantage lies in the fact that the change of format can be obtained both by a reduction and by an increase with respect to a neutral format.

LIST OF THE DRAWINGS

Figure 3:
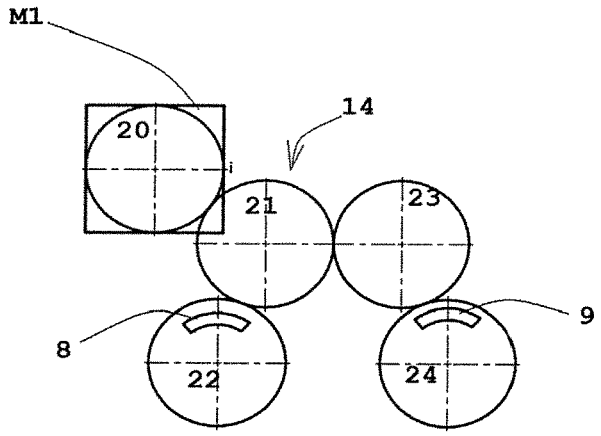
Figure 3A:
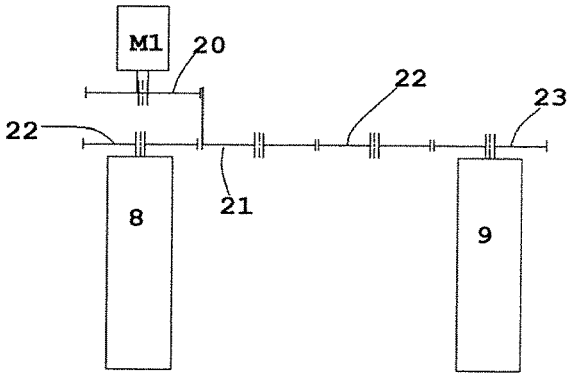
Figure 6A:
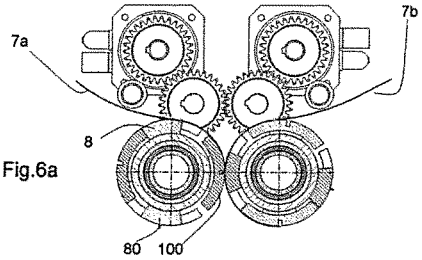
Figure 6B:
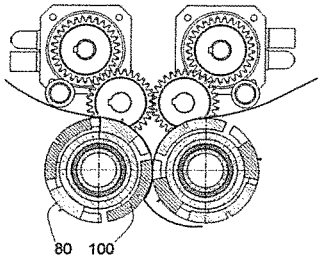
Figure 6C:
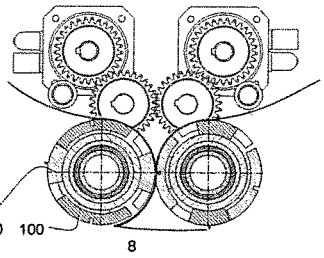
Figure 6D:
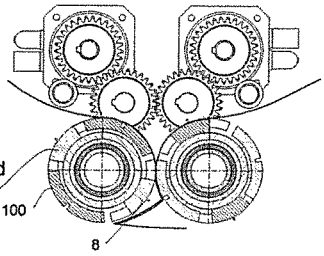
Figure 6E:
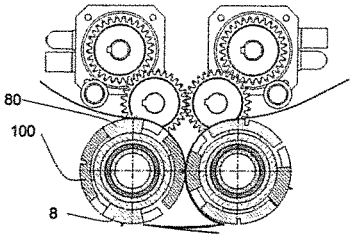
Figure 6F:
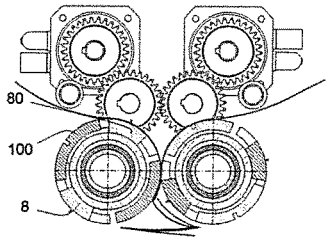
Figure 6G:
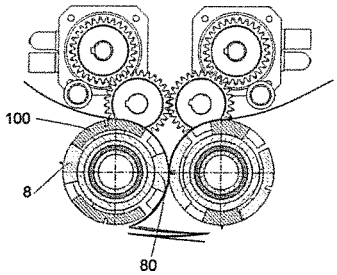
Figure 6H:
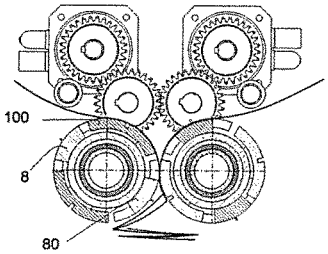
Figure 7:
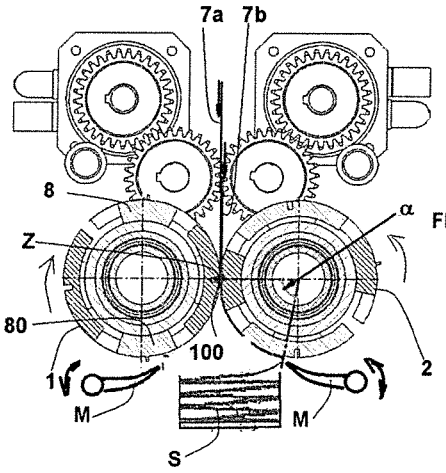

The above and further advantages will be better understood by any person skilled in the branch from the ensuing description and the annexed drawings, which are provided by way of non-limiting example and in which:

FIG. 1 shows schematically in axonometric view an interleaving unit according to the invention;

FIG. 1*a* shows a detail of the mechanism of movement of the unit of FIG. 1;

FIG. 2 shows the unit of FIG. 1 with some parts removed to show internal components that are not normally visible;

FIGS. 3 and 3*a* show respectively a diagram in side view and from above of the motor-drive of the unit of FIG. 1;

FIG. 4*a*-4*h* are schematic illustrations of successive steps of operation of the unit of FIG. 1 in a first configuration of neutral format;

FIG. 5*a*-5*h* are schematic illustrations of successive steps of operation of the unit of FIG. 1 in a second configuration of reduced format;

FIG. 6*a*-6*h* are schematic illustrations of successive steps of operation of the unit of FIG. 1 in a third configuration of increased format; and FIG. 7 shows a further embodiment of the invention.

DETAILED DESCRIPTION

With reference to the annexed drawings, described hereinafter is an interleaving unit, comprising a pair of rolls 1, 2 set alongside one another and counter-rotating and provided with tools 3, 4; 5, 6 set at a distance along the circumferential development of the respective outer peripheral surfaces for operating on a succession of sheets 7*a*, 7*b* fed between the two rolls at a speed Vm.

The tools 3, 4; 5, 6 are set on mobile cylinder sectors 8, 9, 10, 11 to enable their positioning at an adjustable distance apart along the circumferential development of the corresponding roll 1, 2.

According to the invention, the operating unit comprises motor-drive and control means M1, M2, U for independent adjustment of the speed of rotation of one or more of the sectors according to their angular position, in order to reduce or increase the peripheral speed of said sectors with respect to the speed of feed (Vm) of the sheets.

In particular, the sectors 8, 9, 10, 11 comprise at least one first pair of sectors 8, 9 that rotate in synchronism with one another, each on a respective roll 1, 2 and a second pair of sectors 10, 11 that rotate in synchronism with one another, each on the respective roll 1, 2, and the motor-drive and control means M1, M2, U are provided for adjusting independently the speed of rotation of the sectors of said first and second pairs that rotate on each roll 1, 2. Preferably, the means M1, M2, U for adjusting the speed of relative rotation of the sectors of the first and second pairs comprise:

- a first motor M1 provided for moving said first pair of sectors 8, 9, for example via a first gear train 14;
- a second motor M2 independent of the first motor M1 and provided for moving said second pair of sectors 10, 11, for example via a second gear train 15; and
- an electronic control unit U for adjusting the speed of one motor with respect to that of the other and hence the position of the sectors of said first and second pairs 8, 9; 10, 11 along the circumferential development of the respective rolls 1, 2.

Since the speed of the sheets 7 is determined by the operating speed of the machine as a whole, and in particular by the speed of feed of the sheets themselves, thanks to the invention it is possible to vary the speed of the sectors, either reducing it or increasing it in the non-winding path.

In this way, the angular path along which the sectors have the same machine speed Vm or else a different speed is adjusted and controlled so as to fix their position at the moment when the tools carried by the adjacent sectors of each roll 1, 2 are at the point Z for carrying out folding.

Since the format of the sheet depends upon the distance between the folds P, this adjustment enables different formats to be obtained, i.e., reduced or increased with respect to the "neutral" format corresponding to the case where all the sectors have one and the same constant peripheral speed equal to the speed of the sheets 7 processed.

In the embodiment illustrated, the rolls 1, 2, are of the suction type and alternatively draw the folded sheets at least in the angular path subsequent to folding to be able to form the pack S of stacked sheets of FIGS. 1-6 in combination with the detachment hands M that detach the sheet from the rolls to get it to deposit on the underlying pack S being formed.

For this reason, to be able to form sheets of reduced or increased format, the sectors carrying the tools can be accelerated or decelerated only in the angular paths during which they are not constrained to the machine speed by entrainment of the sheets, whilst they must respect the machine speed during entrainment corresponding to the angular winding path "α".

According to the invention, it is consequently envisaged to control the speed of the sectors so that it will correspond to the machine speed during folding and entrainment of the sheets, and to change it, instead, when the sectors are free from the sheets so as to reach at the desired moment the point of folding and then recover the position of start of cycle.

Once entrainment has terminated, the speed of rotation of the sectors can then be increased or reduced at the angle explementary to the winding angle so as to enable the sectors to recover the position of start of cycle, where they have the tools at the desired distance apart and are able to turn at the operating speed imposed by the machine.

In the annexed figures, and in particular in FIGS. 1-3, the structure of a preferred embodiment of the operating unit of the invention is described, comprising four pairs of sectors 8, 9; 10, 11; 80, 90; 100, 110 moved by respective motors M1, M2, M3, M4 about the respective rolls 1, 2 and controlled by the unit U.

With this configuration, packs of interleaved sheets folded in the form of a W can be produced, but it may be understood that in different embodiments of the invention the number of mobile sectors may vary according to the applications and the desired type of folding of the sheets.

In the solution illustrated, the motors and the mobile sectors are connected via a gear train exemplified in FIGS. 3, 3*a* for the gear train 14, which moves the pair of sectors formed by the sector 8 of the roll 1 and the sector 9 of the roll 2 and is constituted by a succession of mechanisms, for example gears 21-24 that take their motion from the motor M1 and turn the sectors 8 and 9 synchronously.

The same kinematic scheme is used for the motor-drive of the remaining sectors.

Preferably, in order to turn the sectors 8, 9, 10, 11, 100, 110, 80, 90 independently, the rolls 1, 2 comprise a central cylinder 12, and the sectors are mounted on respective bushings 13 rotating on the central cylinder 12.

In the example described, the central cylinder 12 has a hollow shape and is connected to the surface of the sectors via pneumatic ducts 18 that extend from the internal cavity of the cylinder. Advantageously, with this solution it is possible to envisage the use of suction means, for example a vacuum pump capable of creating a vacuum in at least one portion of said cavity of the central cylinder 12, which communicates with the ducts 18 and means for opening and closing the ducts 18, for example valves, controlled directly or indirectly by the unit U.

Via the suction means and control of closing and opening of the ducts it is thus possible to alternate states of suction and release of the sheet 7*a*, 7*b* that rest on the winding surfaces A of the sectors.

Furthermore, in order to form a winding surface for the sheets 7*a*, 7*b* that is substantially continuous, the sectors 8, 9, 10, 11, 100, 110, 80, 90 are formed by laterally toothed cylindrical sectors, arranged in such a way that the lateral toothing 16 of one sector of a first pair of sectors (e.g., the sector 8 of the roll 1 in FIG. 1*a*) is axially staggered with respect to and intersects the lateral toothing 17 of the adjacent sector of a second pair of sectors (e.g., the sector 100 of the roll 1).

Illustrated in FIGS. 4*a*-4*h* is the succession of positions assumed by the sectors 8, 9; 10, 11; 80, 90; 100, 110 carrying the respective tools 3, 4, 5, 6, 30, 40, 50, 60, constituted by blades and/or grooves designed for folding or cutting the sheets 7*a*, 7*b* also in co-operation with tools 31, for example contrast blades set above the rolls and mobile.

In this configuration, the interleaving unit carries out a cut to obtain a "neutral" format, in which, that is, the sectors rotate always so that their peripheral speed corresponds to the linear speed of the sheets, or "machine speed".

Figure 4A:
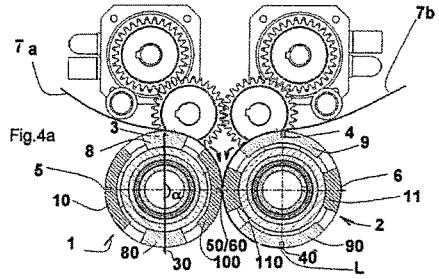
Figure 4B:
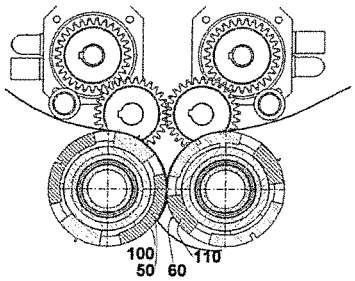
Figure 4C:
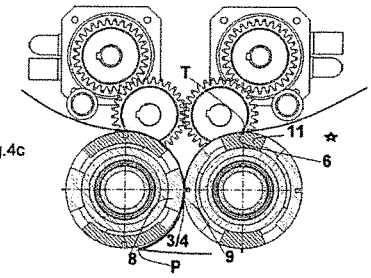
Figure 4D:
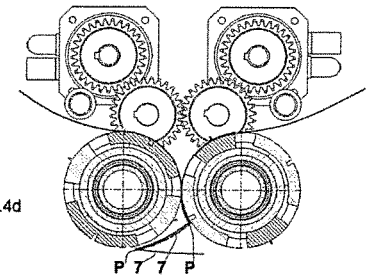
Figure 4E:
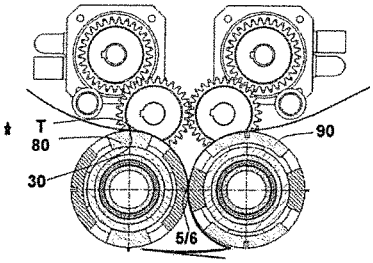
Figure 4F:
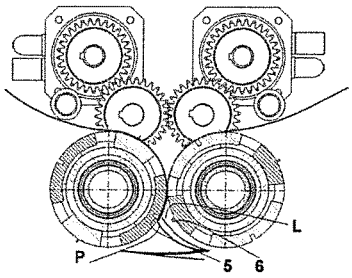
Figure 4G:
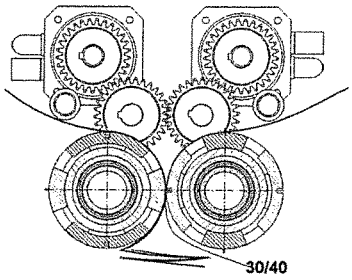
Figure 4H:
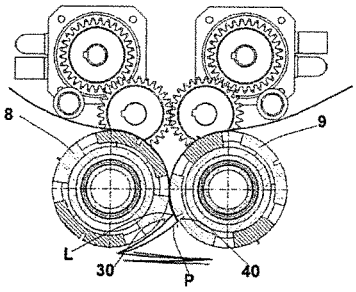

In greater detail:

illustrated in FIG. 4*a* is a position of start of cycle of the rolls 1, 2 with a first sheet 7*a* wound around the first roll 1 between the tools 3 and 50 of the adjacent sectors 8 and 100 and around the second roll 2 between the tools 60 and 40 of the sectors 110 and 90; a second sheet 7*b* is inserted between the two rolls and is wound around the second roll 2 between the tools 4 and 60 of the sectors 9 and 110; the rolls 1 and 2 are subjected suction pressure and withhold the sheets on the winding surfaces of the sectors concerned, whilst the pair of tools 50/60 makes a first fold P on the sheet 7*a;* in FIG. 4*b*, the roll 2 leaves the sheets interleaved, which remain wound around the roll 1;

in FIG. 4*c*, the pair of tools 3/4 makes a second fold P on the coupled sheets 7*a*, 7*b*, whilst the tool 6 of the sector 11 of the roll 2 carries out the cut T on the sheet 7*b;* in FIG. 4*d*, the roll 2 is subjected to suction pressure, and the roll 1 is in a condition of release to obtain the second fold P of the interleaved sheets 7*a* and 7*b*, which deposited underneath;

in FIG. 4*e*, the tool 30 of the sector 80 of the roll 1 makes the cut T of the first sheet 7*a*, while the tools 5/6 of the sectors 10, 11 make a third fold P;

in FIG. 4*f*, there may be noted interleaving of the sheets with the free flaps L of the sheet 7*b* that have already been cut in the step of FIG. 4*c* comprised within the fold P of the sheet 7*a*; the roll 2 is in a condition of release, and the roll 1 is subjected to suction pressure;

in FIG. 4*g*, the roll 2 is still in a condition of release, and the roll 1 is subjected to suction pressure to obtain the third fold P of the interleaved sheets 7*a* and 7*b*, which deposit underneath; the tools 30 and 40 of the sectors 80 and 90 make a fourth fold P of the sheets; and in FIG. 4*h*, there may be noted the interleaving of the sheets with the free flaps L of the sheet 7*a* that have already been cut in the step of FIG. 4*e* comprised within the fold P of the sheet 7*b*.

Then, the cycle resumes as shown in FIG. 4*a*.

Illustrated in FIGS. 5*a*-5*h* is the succession of the steps of folding and suction/release already described in relation to FIGS. 4*a*-4*h*.

What changes is the relative position of the adjacent sectors and of the respective tools, the distance between which at the point of tangency Z defines the format of the sheet being processed.

In FIGS. 5*a*-5*h*, in fact, the succession of positions assumed by the adjacent sectors of each roll has been set in order to carry out a cut of reduced format, in which, that is, the distance between the tools on the adjacent sectors of the rolls 1 and 2, for example the sectors 8/100 and 9/110 have been reduced with respect to the neutral format; i.e., the sectors 8/100 and 9/110 arrive to the point of tangency Z with a shorter distance apart.

In the embodiment described, the sheets 7*a* and 7*b* are constrained to the surface of the rolls (alternatively) both upstream and downstream of the point of tangency Z.

With this solution, the angular path $\alpha$ of winding is defined by the angles $\alpha 1$ and $\alpha 2$ fixed by the angular position of the free leading and trailing flaps L of the sheet being processed, during which path the sheet is subtended by the sector concerned, and this must turn at the machine speed.

The sectors can, instead, accelerate through the angle of rotation explementary to the respective winding angle to recover the position of start of cycle.

In greater detail, there may be noted the succession of the positions assumed by the sectors 80, 100, 8 of the roll 1, which carry out in succession folding of the sheet synchronously with the sectors 90, 110 and 9 of the roll 2.

Similar considerations apply to the other sectors.

Figure 5A:
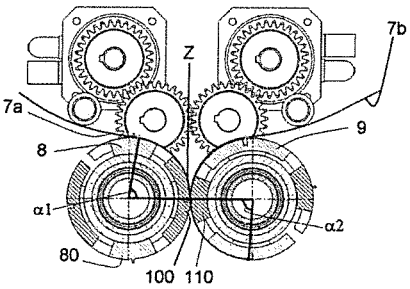
Figure 5E:
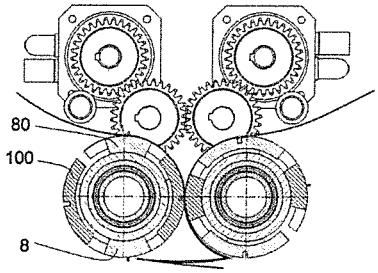
Figure 5B:
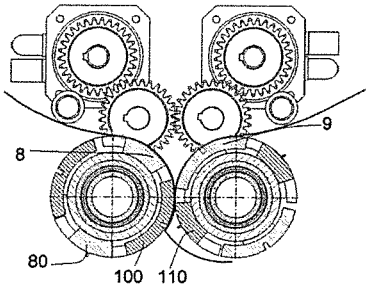
Figure 5F:
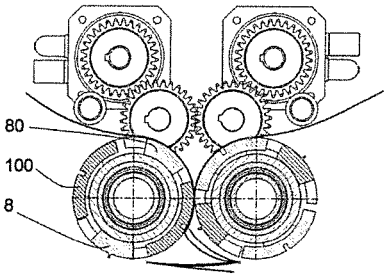

In FIG. 5*a*, the sector 100 is at the point of tangency Z, carries out folding of the sheet, and precedes the sector 8. The sectors 8 and 100 have a distance corresponding to the desired reduced format; i.e., they are set closer to one another than in the case of FIG. 4.

Figure 5C:
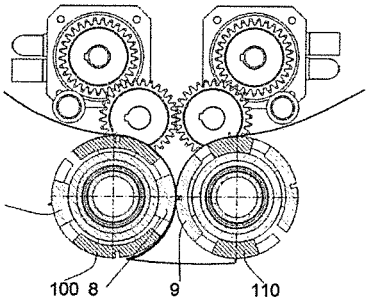
Figure 5G:
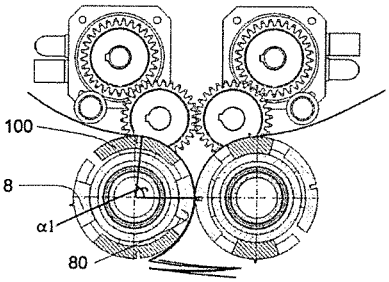
Figure 5D:
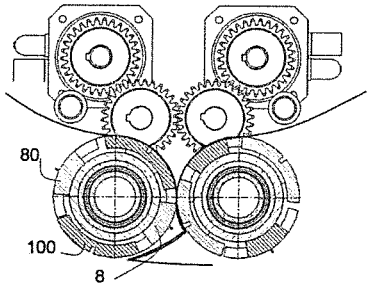
Figure 5H:
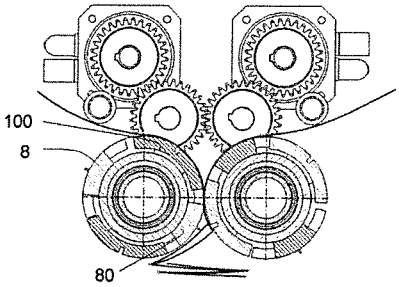

The shorter distance between the sectors 100 and 8, and the machine speed of both, is maintained up to the step of FIG. 5*c*, where the sector 8 makes the next fold, and the sheet detaches from the sector 100, which can accelerate and progressively recover the reduced distance, approaching the preceding adjacent sector 80 up to the step of FIG. 5*g*, where the sector 80 makes the fold, releases the sheet, and in turn prepares to accelerate.

Illustrated in FIGS. 6*a*-6*h* is the succession of the steps of folding and suction/release in the case where the succession of positions assumed by the adjacent sectors of each roll has been set for making a cut of increased format, in which, that is, the distance between the tools on the adjacent sectors of the rolls 1 and 2, for example, the sectors 8/100 and 9/110, has been increased with respect to the neutral format; i.e., the sectors 8/100 and 9/110 arrive at the point of tangency Z with a greater distance apart.

In greater detail, there may be noted the succession of the positions assumed by the sectors 80, 100, 8 of the roll 1, which carry out in succession folding of the sheet synchronously with the sectors 90, 110 and 9 of the roll 2.

Similar considerations apply to the other sectors.

In FIG. 6*a*, the sector 100 is at the point of tangency Z, carries out folding of the sheet, and precedes the sector 8. The sectors 8 and 100 have a distance corresponding to the desired increased format; i.e., they are spaced at a greater distance apart as compared to the case of FIG. 4.

The greater distance between the sectors 100 and 8 and the machine speed of both is maintained up to the step of FIG. 5*c*, where the sector 8 makes the next fold, and the sheet detaches from the sector 100, which can then decelerate and progressively recover the desired distance, moving away from the preceding adjacent sector 80 up to the step of FIG. 5*g*, where the sector 80 makes the fold, releases the sheet, and in turn prepares to decelerate.

Illustrated schematically in FIG. 7 is an application of the invention, in which the sheet is fed tangentially to the rolls, and the angular winding path is limited to the surface of the rolls downstream of the point of tangency Z up to the point of separation of the sheet from the roll determined by the detachment hands M.

Adjustment of the speed of the sectors is made as already described by maintaining the machine speed during folding and entrainment, and changing the speed when the sector concerned is not constrained by the contact with the sheet and can accelerate or decelerate according to the desired sheet format.

In this application, the sheets reach the point of tangency already staggered (this staggering is obtained by a unit set upstream) by the amount that is necessary to obtain the pre-set format.

Thanks to the invention, the distance of the tools can be adapted to the required staggering according to the format that is to be obtained, and likewise the unit S that comprises the detachment hands M will have to adapt to the various formats.

FIG. 7 regards processing of interleaved sheets folded to form a Z, but it is understood that the same operation and the same advantages also apply to sheets folded in other ways, for example in the form of a W.

The present invention has been described according to preferred embodiments, but equivalent variants may be devised, without thereby departing from the sphere of protection granted.

The invention claimed is:

1. An interleaving unit, comprising:

a pair of rolls set alongside one another and counter-rotating and provided with respective first and second folding tools set at a distance from one another along a circumferential development of respective peripheral surfaces so as to operate in a common point of tangency on a succession of sheets fed between the pair of rolls, said first and second folding tools being set on respective mobile cylinder sectors to enable positioning thereof at an adjustable distance apart along the circumferential development of a corresponding roll;

a means for independently adjusting a speed of rotation of one or more of said mobile cylinder sectors according to an angular position of said mobile cylinder sectors in order to reduce or increase a peripheral speed of said mobile cylinder sectors with respect to a speed of feed of said sheets.

2. A unit according to claim 1, wherein said mobile cylinder sectors comprise at least one first pair of sectors and a second pair of sectors, each of said at least one first pair of sectors rotating in synchronism with one another on a respective roll, each of said second pair of sectors rotating in synchronism with one another on a respective roll, and said means for adjusting the speed of the relative rotation of sectors of said at least one first pair of sectors and said second pair of sectors comprises:

a first motor for moving said first pair of sectors;

a second motor independent of the first motor for moving said second pair of sectors;

a control unit for adjusting a speed of one of the first motor and the second motor with respect to another one of the first motor and the second motor and a relative position of the sectors of the first pairs of sectors and the second pair of sectors along the circumferential development of the pair of rolls.

3. A unit according to claim 2, wherein said pair of rolls comprise a central cylinder, and said mobile cylinder sectors are mounted on bushings rotating on said central cylinder.

4. A unit according to claim 2, wherein said sectors of said first pair of sectors and said second pair of sectors are connected to said first motor and said second motor via respective gears chains.

5. A unit according to claim 2, wherein said means for adjusting the speed of rotation of the sectors of said first pair of sectors and said second pair of sectors are provided for turning the mobile cylinder sectors of the pair of rolls at the feed speed over a winding angular path, wherein at least one sheet is entrained by at least one of the pair of rolls, and at different speeds over a non-winding angular path.

6. A unit according to claim 1, wherein said mobile cylinder sectors comprise laterally toothed cylindrical sectors, said mobile cylinder sectors being arranged such that a lateral toothing of one sector of a first pair of sectors is axially staggered with respect to and intersects a lateral toothing of an adjacent sector of a second pair of sectors so as to form a substantially continuous winding surface for at least one of the sheets.

7. A unit according to claim 1, wherein said mobile cylinder sectors comprise four pairs of sectors moved by respective motors.

8. A unit according to claim 1, wherein said pair of rolls comprise a central hollow cylinder and ducts extending from cavity of the central hollow cylinder to a surface of at least one of the mobile cylinder sectors.

9. A unit according to claim 8, further comprising:

a suction means for creating a vacuum in at least one portion of said cavity of the central hollow cylinder that communicates with said ducts and;

a means for opening and closing said ducts.

10. A method for interleaving a succession of sheets by an interleaving unit, the interleaving unit comprising a pair of rolls set alongside one another and counter-rotating and provided with respective first and second folding tools set at a distance from one another along a circumferential development of respective outer peripheral surfaces to operate on a succession of sheets fed between the pair of rolls at a speed of feed, said first and second folding tools being set on respective cylinder sectors, the method comprising:

independently adjusting a peripheral speed of one or more of said cylinder sectors at a constant value equal to said speed of feed over a winding angular path, at least one sheet being entrained by at least one of said pair of rolls, and at different speeds over a non-winding angular path, in order to increase or reduce or maintain constant an angular distance between said cylinder sectors.

* * * * *